US007332045B2

(12) United States Patent
Shanbaum

(10) Patent No.: US 7,332,045 B2
(45) Date of Patent: Feb. 19, 2008

(54) AUTOMATIC BLOCKING AND LENS BLANK MEASURING APPARATUS AND METHOD

(75) Inventor: Robert Shanbaum, Manchester, CT (US)

(73) Assignee: Gerber Scientific International, Inc., South Windsor, CT (US)

( * ) Notice: Subject to any disclaimer, the term of this patent is extended or adjusted under 35 U.S.C. 154(b) by 0 days.

(21) Appl. No.: 11/222,935

(22) Filed: Sep. 8, 2005

(65) Prior Publication Data

US 2006/0055929 A1 Mar. 16, 2006

Related U.S. Application Data

(60) Provisional application No. 60/609,982, filed on Sep. 15, 2004.

(51) Int. Cl.
*B32B 41/00* (2006.01)

(52) U.S. Cl. ..... 156/64; 156/360; 156/378; 156/379

(58) Field of Classification Search ..... 156/64, 156/360, 378, 379
See application file for complete search history.

(56) References Cited

U.S. PATENT DOCUMENTS

| | | | | |
|---|---|---|---|---|
| 2,352,616 | A | 7/1944 | Canning | |
| 3,893,264 | A | 7/1975 | Behnke | |
| 4,656,590 | A | 4/1987 | Ace | |
| 4,724,617 | A | 2/1988 | Logan et al. | |
| 4,989,316 | A | 2/1991 | Logan et al. | |
| 5,042,935 | A | 8/1991 | Logan et al. | |
| 5,053,971 | A | 10/1991 | Wood et al. | |
| 5,210,695 | A | 5/1993 | Wood | |
| 5,269,102 | A | 12/1993 | Wood | |
| 5,341,604 | A | 8/1994 | Wood | |
| 5,349,787 | A | 9/1994 | Wood | |
| 5,505,654 | A | 4/1996 | Wood et al. | |
| 6,813,536 | B1 * | 11/2004 | Gottschald | 700/160 |

FOREIGN PATENT DOCUMENTS

WO WO99/39869 * 8/1999

OTHER PUBLICATIONS

Website: http://www.gerbercoburn.com/products/blockeclipse.htm; May 27, 2004.
Website: http://web.archive.org/web/20021022101036/www.gerbercoburn.com/10-documents/eclipse.html; Oct. 22, 2002.
Website: http://web.archive.org/web/20000302013732/http://www.gerbercoburn.com; Jul. 30, 1999.

(Continued)

*Primary Examiner*—George Koch
(74) *Attorney, Agent, or Firm*—Morgan & Finnegan LLP

(57) ABSTRACT

An apparatus and method for automatically blocking and providing measurement of a lens blank during the blocking process includes an alignment station and a blocking station. The alignment station aligns a lens blank to a block for bonding that is also known as the blocking process. The blocking station includes a lens blank measurement system having sensors that automatically identify and determine measurement and alignment information about the lens, such as sag and tilt of the lens blank, during the blocking process.

20 Claims, 6 Drawing Sheets

OTHER PUBLICATIONS

Website: http://web.archive.org/web/20000121183242/www.gerberoptical.com/news/19990730.hts?_home; Jul. 30, 1999.
Website: http://web.archive.org/web/20001218063900/www.gerbercoburn.com/03-Surfacing/index.html; 1998.
Website: http://web.archive.org/web/20010828222820/www.gerbercoburn.com/10-documents/steponeb.html; 1998.
Website: http://web.archive.org/web/20001218042700/www.gerbercoburn.com/02-Premier/index.html; 1998.
Website: http://web.archive.org/web/20010828222826/www.gerbercoburn.com/10-documents/steptwo.html; 1998.

* cited by examiner

AUTOMATIC BLOCKING AND LENS BLANK MEASURING APPARATUS AND METHOD

CROSS REFERENCE TO RELATED APPLICATION

This application claims priority under 35 USC 119(e)(1) of U.S. Provisional Patent Application Ser. No. 60/609,982, filed Sep. 15, 2004.

FIELD OF THE INVENTION

This invention generally relates to a blocking apparatus for an ophthalmic lens blank, and more particularly to an automatic blocking and lens blank measuring apparatus and method.

BACKGROUND OF THE INVENTION

In the creation of a lens surface using surfacing generating systems, such as disclosed in U.S. Pat. No. 4,989,316 issued to Logan et al., data describing prescription information is transmitted to the surface generating system, and is thereafter used by the machine to cut the interiorly disposed surface of the lens to create the desired lens. Automatic lens blocking machines presently in the marketplace, such as disclosed in U.S. Pat. No. 5,505,654 issued to Wood et al., bond the finished outer surface of the lens blank to a block for holding the lens so that it can be placed in the surfacing machine during a cutting operation and in a lapping machine during the fining and polishing process. In these machines, the lens blank is precisely positioned in a blocking station where a block is bonded to the lens blank.

Generally, the lens blank outer surface and the block must be bonded in precise alignment with one another in accordance with prescription data and manufacturing parameters because the surface generator machines the inner surface with reference to the block, and the correct prescription can be achieved only if the inner surface of the lens blank is aligned correctly with the outer confronting surface of the block. This relative positioning of the block and the lens blank opposing surfaces affects the accuracy of obtaining a desired lens thickness, since this outcome is dependent on the spacing of the block and the outer surface of the lens blank. Also, prismatic power depends on centering and skewing of the block on the outer surface of the lens blank. Cylinder power axis, required for astigmatism correction, depends on angular orientation of the block relative to any rotationally asymmetrical elements on the outer surface of the lens blank. Thus, a number of factors influence the relative positioning of the lens blank relative to the block. However, once the block is bonded to the lens blank, it is difficult to ascertain information about the specific lens blank, such as measurements that may be useful for ultimate surface generation of the lens blank, such as the center point of the lens blank or any tilt of the lens blank with respect to the block.

In existing blocking machines in the marketplace, sensors are provided for alerting the user if a lens blank or a block is not detected at the blocking station before blocking is initiated. Additionally, sensors are provided to automatically start and stop the flow of bonding material so as to eliminate material overflow in the blocking station. Further, existing machines have used sensors positioned within the center of a block reservoir of a blocking station to detect the presence of the lens blank and the depth of the lens blank when pressed down thereby. However, these existing machines and sensors do not provide adequate information about the lens blank, such as sag and tilt, which information is difficult to ascertain once the block is bonded to the lens blank.

It is therefore an object of the present invention to provide an apparatus of the aforementioned type in which measurement data about a lens blank is automatically sensed and determined during the blocking process.

A further object of the present invention is to provide a blocking station having a block sensing support system which, during a bonding operation, senses data regarding the lens blank, including the existence and amount of sag and tilt thereof.

SUMMARY OF THE INVENTION

The present invention is directed to a blocking apparatus for an ophthalmic lens blank of the type having an exteriorly disposed outer surface and an interiorly disposed inner surface capable of being machined to satisfy a given prescription, wherein the exteriorly disposed outer surface of the lens blank is bonded to a block for mounting the lens/block combination in a surfacing generator where the inner surface is machined to achieve a desired prescription. More particularly, the present invention is directed to an apparatus for automatically blocking the lens blank where measurements of the lens blank are taken, which measurements can be ultimately coordinated with data describing prescription information for the lens.

Furthermore, the present invention resides in an apparatus and related method for automated blocking of an ophthalmic lens blank, as well as for providing desired measurements of the lens blank. The apparatus comprises a base and an alignment station supported by the base for supporting and aligning a lens blank for blocking. A blocking station is also provided and is supported by the base for bonding a block to the lens blank in a given orientation relative to the base. A transport means is located intermediate and adjacent the alignment and blocking stations for moving the lens blank from the alignment station to the blocking station while maintaining a desired lens blank orientation established at the alignment station. The blocking station includes a lens blank support, a block reservoir, and means for injecting heated liquid bonding material between lens blank and block which solidifies on cooling to join the lens blank and the block to one another. The blocking station also includes a lens blank measurement system, including sensors, which automatically identify and determine measurement and alignment information about the lens blank, such as sag and tilt of the lens blank, during the blocking process.

DETAILED DESCRIPTION OF THE INVENTION

Figure 1:
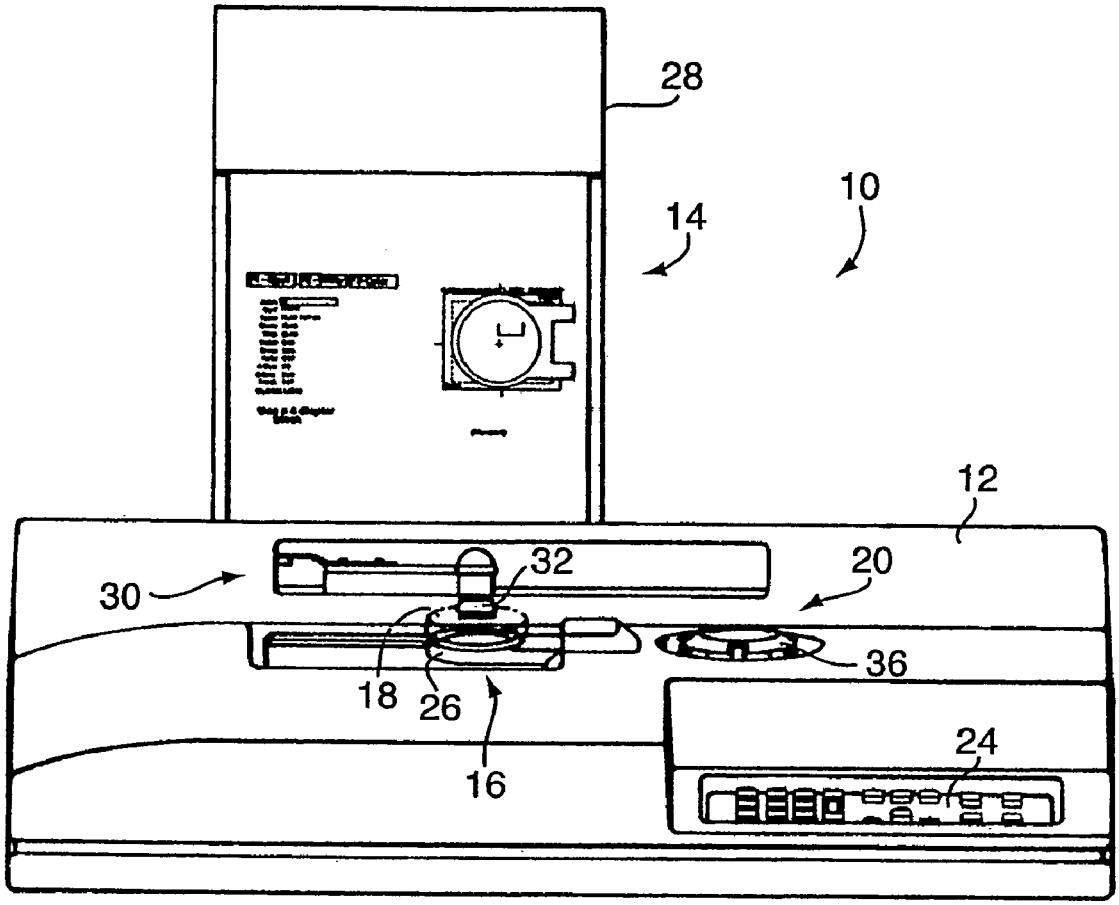
FIG. 1 is a front elevation view of the automated blocking and measuring apparatus of the present invention as covered by a housing.

The present invention is directed to a lens blocking apparatus of the general type described and illustrated in U.S. Pat. No. 5,505,654 to Wood et al., incorporated herein by reference. FIG. 1 illustrates a preferred structure for such an automated lens blocking apparatus 10 embodying the present invention. The apparatus 10 is of the type that can be placed on a support, such as, the flat surface of a table, and operated by a user if desired while sitting.

Figure 2:
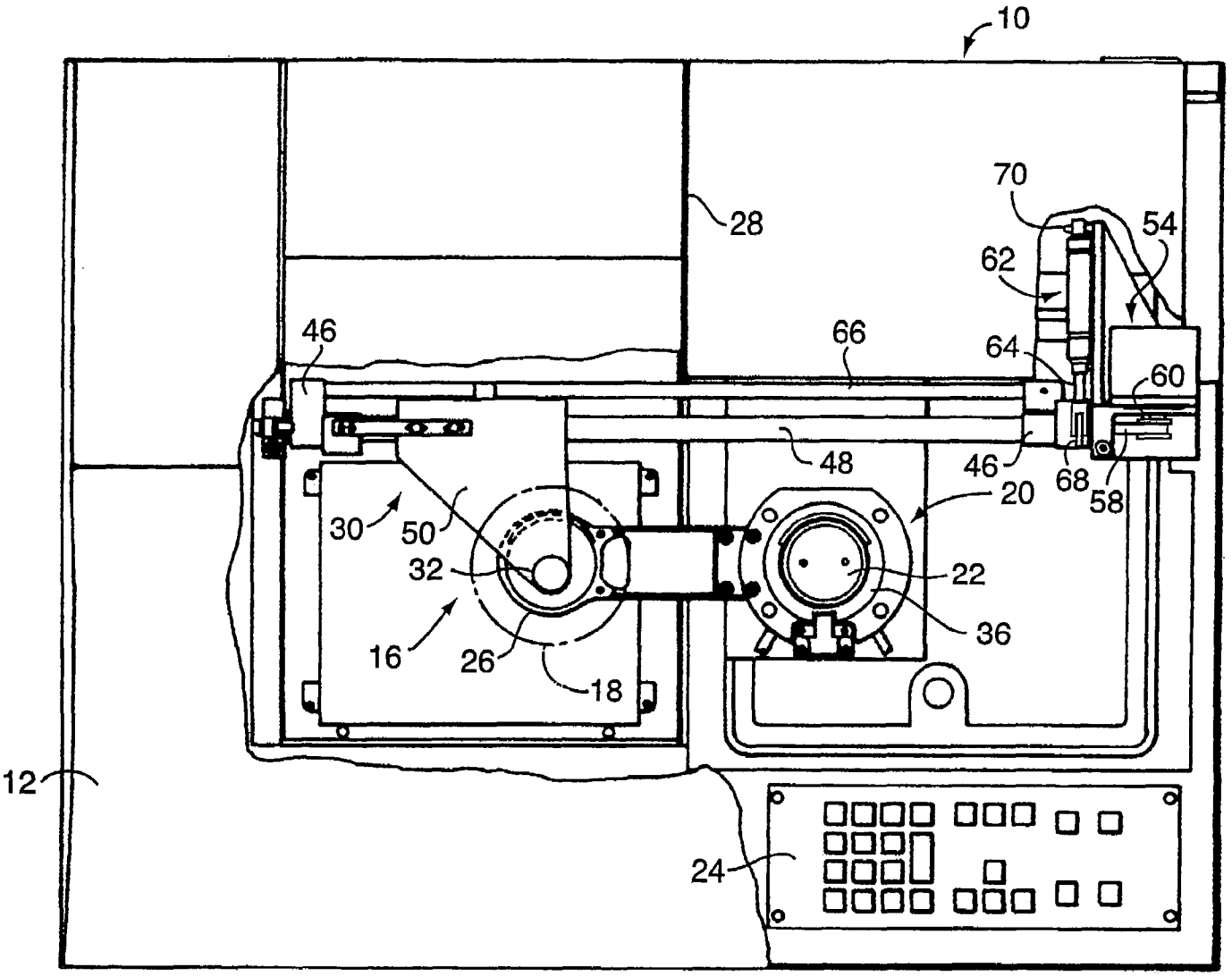
FIG. 2 is a top plan view of the apparatus of FIG. 1 with the housing removed.
Figure 3:
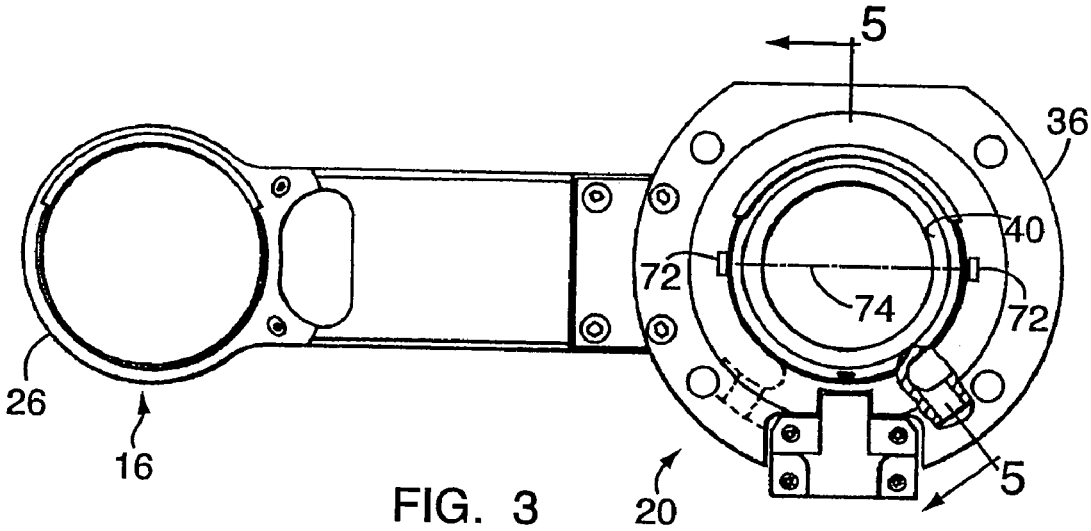
FIG. 3 is a top plan view of the alignment station and blocking station of the apparatus of the present invention.

As best illustrated in FIGS. 1-3, the apparatus 10 is comprised of a base 12 with a display screen 14, an alignment station 16 where a lens blank 18 can be aligned in accordance with a pre-desired orientation, and a blocking station 20 where the lens blank 18 can be bonded to a lens block 22, each supported by the base 12. A user interface is provided in the form of a keypad 24 that is linked to appropriate controls in the apparatus 10 to cause automatic blocking of the lens blank 18 to the lens block 22 in a manner provided in accordance with the invention.

The alignment station 16 and the blocking station 20 are generally adjacent one another. The alignment station 16 includes an alignment support ring 26 having an upwardly directed annular edge for supporting the lens blank 18. An optical tower 28 is disposed above the display screen 14 to present the user with a visual representation of the lens blank alignment in the alignment support ring 26. A pick-and-place transport mechanism 30 is also provided and includes a releasable gripper 32 controllably positioned between a first location located coincidentally with the alignment support ring 26 and a second location located coincidentally with the blocking station 20. The pick-and-place mechanism 30 further is provided with means capable of lifting the lens blank 18 off the alignment support ring 26, transporting it to the blocking station 20, and placing it at the blocking station 20 relative to the block 22.

The components and operation of the blocking apparatus 10 are similar to that described and illustrated in U.S. Pat. No. 5,505,654. In short, operation of the apparatus 10 is controlled by a central controller. The controller is operatively linked to the display screen 14, the pick-and-place transport mechanism 30, the gripping means 32, and various sub-controllers and sensors, including those associated with the present invention for measuring and determining information regarding the lens blank 18.

Referring now to FIGS. 2-5, the blocking station 20 includes a support for supporting the lens block 22 to be bonded to an associated lens blank 18, and a reservoir having a supply of bonding material in liquid form provided to releasably secure the lens blank 18 to the block 22 at the blocking station 20. More particularly, the blocking support includes a blocking ring 36 (also referred to as a chill ring) secured relative to the base 12 and defining a cavity 38 (see FIG. 5) for the purpose of receiving and supporting the block 22 and an upwardly directed planar surface 40 on which the lens blank 18 rests. During the blocking process, the lens blank 18 is positioned on the blocking ring 36. More particularly, the blocking ring 36 and the cavity 38 are specifically adapted to simultaneously hold the lens blank 18 and the block 22 in spaced vertical relationship in order that a bonding material is interposed therebetween. Interposed between the blocking ring 36 and the cavity 38 is a fluid passage 42 for the purpose of delivering and introducing the liquefied bonding material into the interior confines of the cavity 38 through an inlet 44. Preferably, the bonding material fills the cavity 38 during the blocking process up to the upwardly directed planar surface 40 of the blocking ring 36.

Figure 6:
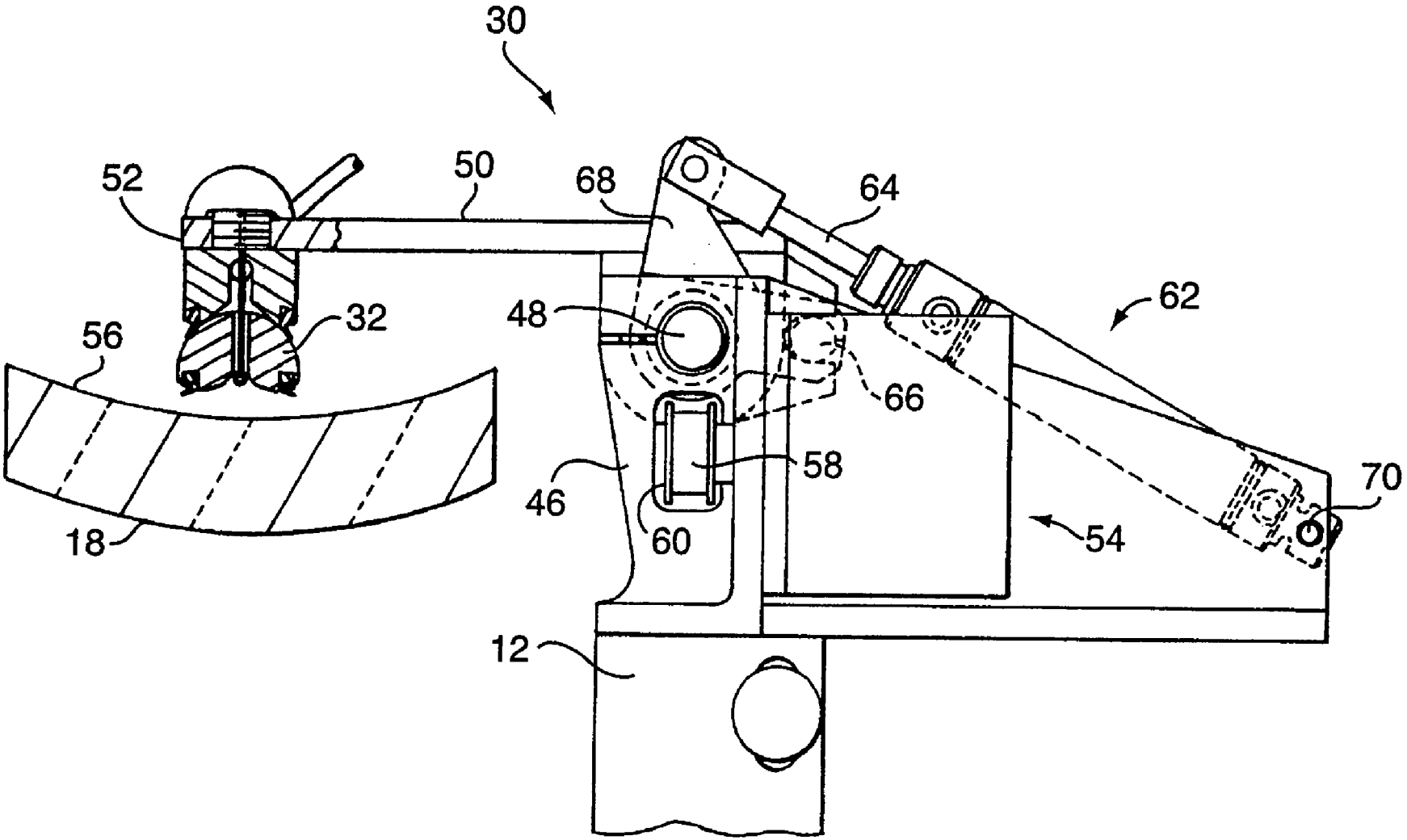
FIG. 6 is a partially fragmentary side elevation view of the transport mechanism of the apparatus of the present invention.
Figure 7:
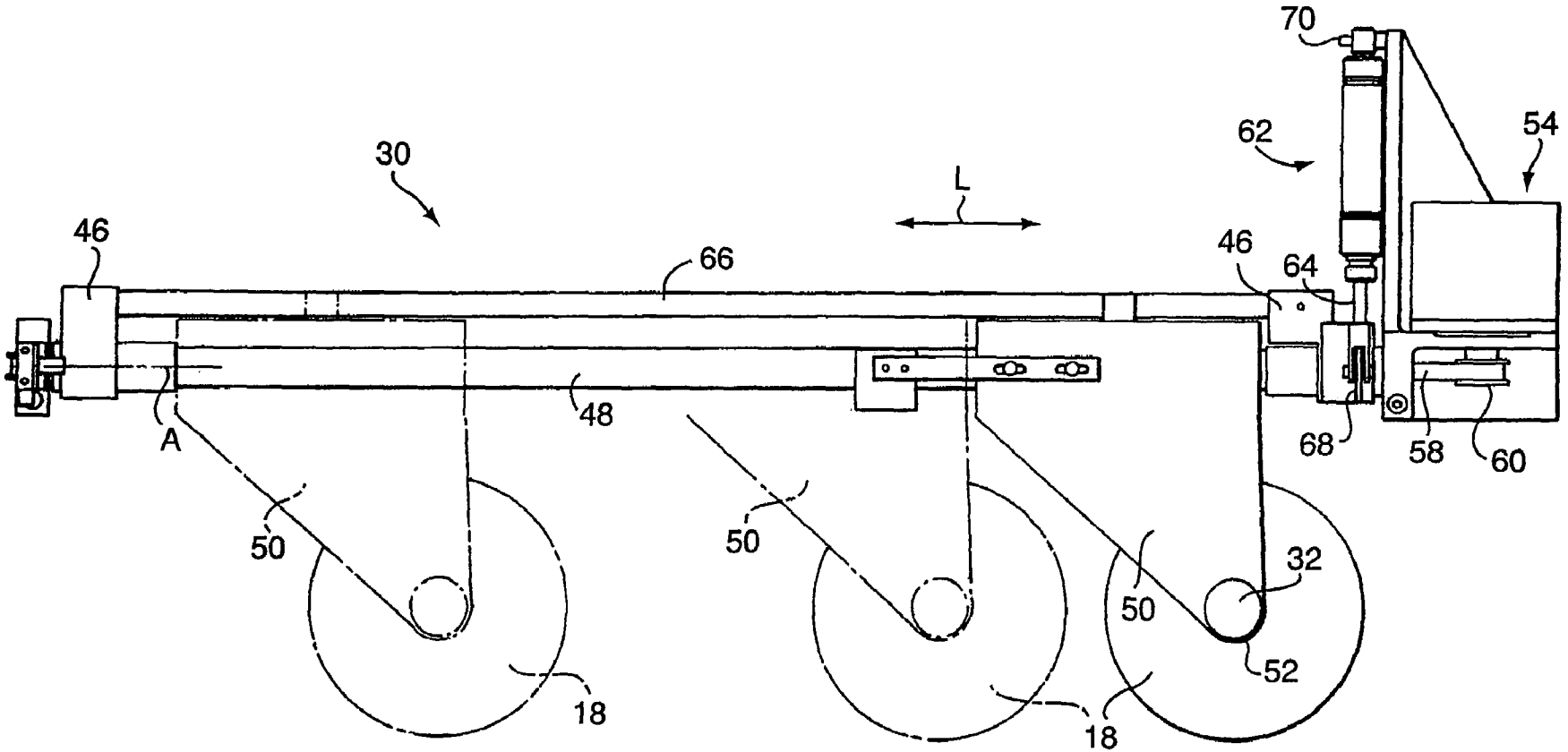
FIG. 7 is a top plane view of the transport mechanism of FIG. 6.

Referring now to FIGS. 6 and 7, and in particular to the details of the pick-and-place transport mechanism 30, it should be seen that this mechanism includes two spaced vertically extending support posts 46 disposed on the base 12, a guide 48 having a central axis "A" and secured against movement within the posts 46 at its opposite ends, and a transport arm 50 disposed for linear movement along the guide 48. The transport arm 50 is driven in the indicated "L" direction by a drive means 54 and pivoted about the axis "A" of the guide 48 through the intermediary of a pivot actuator 62. The transport arm 50 is cantilevered outwardly of the guide 48 and carries at its distal end 52 a vacuum operated gripper 32 adapted to engage the inner surface 56 of the lens blank 18, as shown in FIG. 6.

Movement of the transport arm 50 in the L direction is preferably effected by a belt and pulley mechanism (such as belt 58 and pulley 60 illustrated in FIG. 7), although any known drive means may be used in the present invention. Pivotal movement of the transport arm 50 is effected by the pivot actuator 62 which may take any known actuator form, be it mechanical, electrical, pneumatic or hydraulic. As shown, the actuator 62 is a double acting actuator having a sliding actuator rod 64, and a drive bar 66 extending substantially parallel to the axis A of the guide 48 and held in spaced parallel relationship with the guide 48. A lever 68 is integrally connected with the guide 48 and projects radially outwardly of the axis A. The lever 68 is connected to the double acting actuator 62 such that the sliding actuator rod 64 is pivotally connected at its free end to the lever 68, while its opposite end is connected to the base 12 at a second pivot location 70. General operation of the transport arm 50 is controlled by the controller, and through the connection with the actuator 62, the transport arm 50 is caused to pivot between a lowered position resulting from the actuator 62 being extended, and a raised position corresponding to the retraction of the actuator 62.

The transport arm 50, as illustrated in FIG. 6, is cantilevered outwardly of the guide 48 such that the gripper 32 carried thereby is positioned for engagement with the interior surface 56 of the lens blank 18. When the transport arm 50 is moved to its lowered position, the gripper 32 engages the lens blank 18. For the purpose of holding the lens blank 18 for movement with the transport arm 50, the gripper 32 is connected to a vacuum source (not shown) and is flexible to accommodate the arcuate shape of the lens blank 18. Once seating of the gripper 32 on the inner surface 56 is accomplished, the vacuum communicating within the gripper 32 serves to hold the lens blank 18 to the gripper 32.

Figure 5:
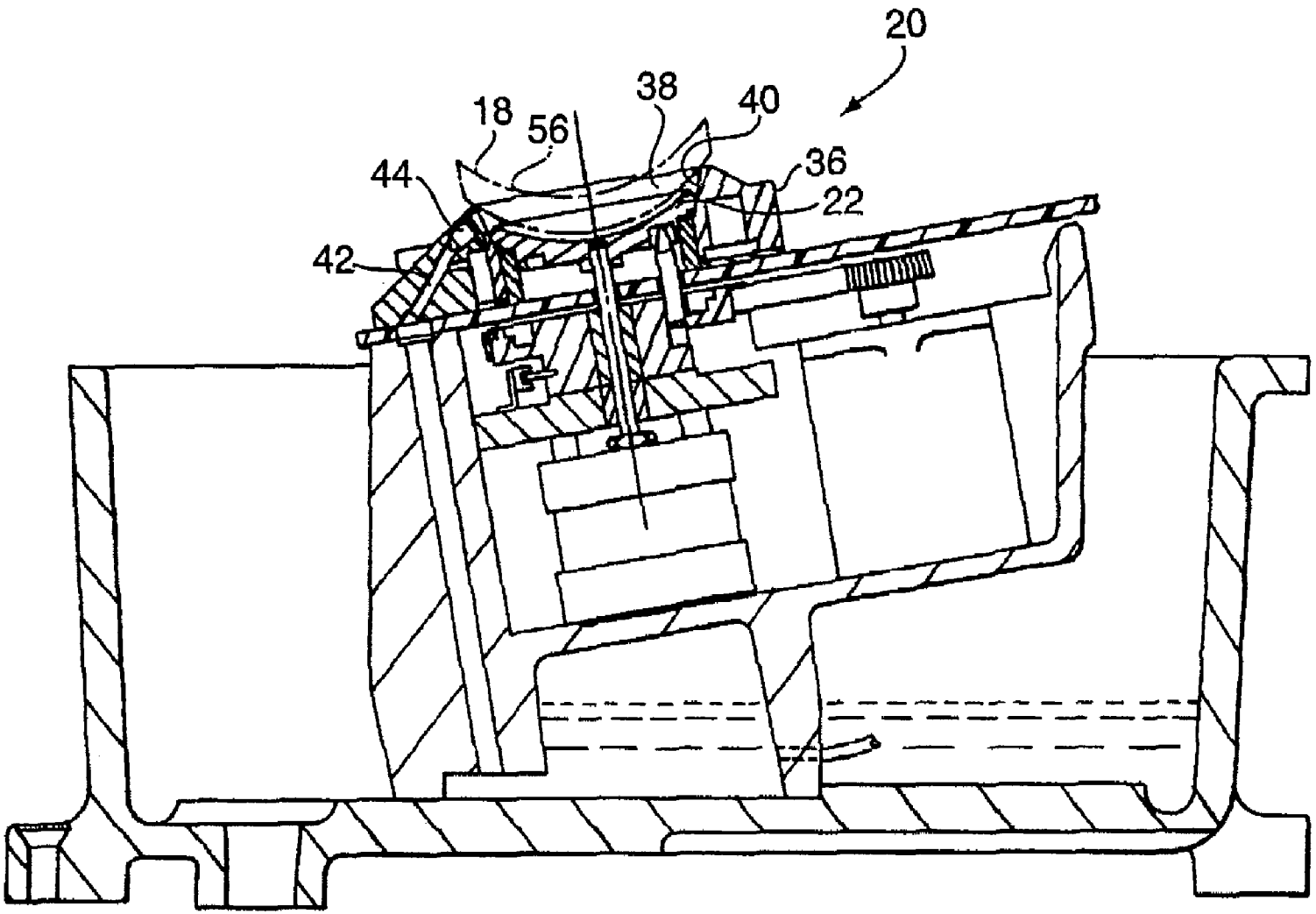
FIG. 5 is a partially fragmentary vertical section view taken along line 5-5 of FIG. 3 showing the blocking station of the apparatus of the present invention.

Referring to FIGS. 1, 2 and 5, in operation, a lens blank 18 is positioned by the user on the alignment support ring 26. Similarly, a block 22 is positioned within the cavity 38 of the blocking ring 36. After the lens blank 18 is aligned at the alignment station 16 in accordance with a desired alignment for a particular surfacing operation, the user prompts the apparatus 10, typically using the keypad 24, to transport the aligned lens blank 18 to the blocking station 20 for placement on the blocking ring 36 in the desired orientation.

Transport of the lens blank 18 is achieved by moving the transport arm 50 from its park position to the position over the alignment support ring 26. The transport arm 50 pivots downwardly into engagement with the upwardly facing inner surface 56 of the lens blank 18. Vacuum is applied through the gripper 32 so that the lens blank 18 is held by the transport arm 50 and gripper 32. With the lens blank 18 held by the gripper 32, the transport arm 50 pivots to a raised transport position clear of the alignment station 16. The transport arm 50 is then linearly moved from the first location to the second location of the blocking station 20 and positioned over the blocking ring 36 in a desired alignment with respect to the lens block 22.

When the lens blank 18 is aligned above the blocking ring 36, the transport arm 50 is pivoted downwardly to place the lens blank 18, preferably squarely, on the blocking ring 36. The gripper 32 remains in engagement with the lens blank 18 during the bonding process, wherein the bonding material is supplied into the cavity 38 through inlet 44 to bond the lens blank 18 to the block 22. During this process, the transport arm 50 applies a downward clamping force on the lens blank 18 to maintain its position on the blocking ring 36. The transport process of the lens blank 18 using the present apparatus 10 is automatically controlled by the controller 34.

It is preferred in the blocking process to insure that the lens block 22 is flushly seated within the cavity 38 and the lens blank 18 is flushly positioned on blocking ring 36 before the bonding material is injected. To these ends, sensing means are provided as part of the blocking station 20 to ensure proper seating of the block 22 during the bonding process. These means are described in more detail in U.S. Pat. No. 5,505,654, incorporated herein by reference. Additionally sensing means are provided to ensure the presence of the lens blank 18 at the blocking station 20 before injection of the bonding material.

Figure 8:
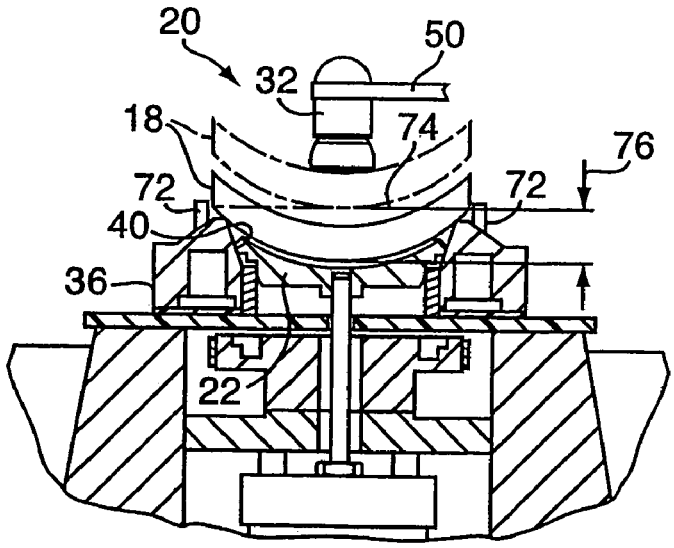
FIG. 8 is an enlarged partial view of a blocking station like that shown in FIG. 5.
Figure 4:
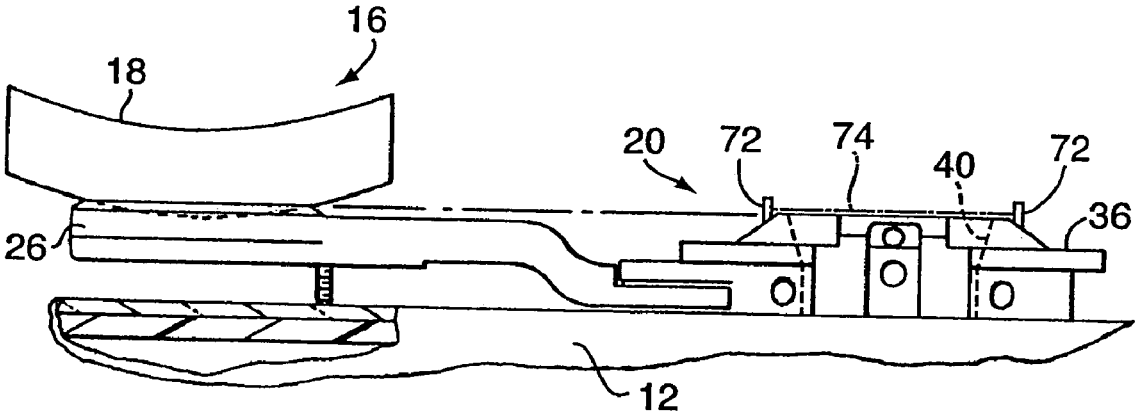
FIG. 4 is a side elevation view of the alignment station and blocking station of FIG. 3.

Referring to FIGS. 3,4, and 8, to further assist in preparation of the lens blank 18 and block 22 for surface machining, sensors are provided in accordance with the present invention to provide measurements of the lens blank. In a preferred embodiment illustrated in FIGS. 3,4, and 8, at least one beam yoke 72 is positioned around the periphery of the blocking ring 36 for detecting when the lens blank 18 is being placed at the blocking station 20. More particularly, the beam yoke 72 generates a beam, represented by reference numeral 74, that senses the presence of the lens blank 18 and signals the controller 34 to initiate desired measurements, such as sag and tilt, when the beam 74 is interrupted by the presence of the lens blank 18. FIG. 8 shows a lens blank 18 in phantom at a position where in encounters the beam 74. Ideally, the beam 74 is substantially aligned with the likely path of the center point of the lens blank 18 as it is lowered into position on the blocking ring 36.

Working in conjunction with the beam yoke 72 is a rotary encoder associated with the transport arm 50. The rotary encoder measures the pivot of the transport arm 50 and provides data to the controller 34. The movement of the transport arm 50 may be measured by apparatus other than a rotary encoder. Alternatively, if a transport arm were used that moved linearly instead of pivotally, the encoder or other movement measuring apparatus could measure the linear distance 76 between the position the lens blank 18 interrupts the beam 74, and the position where the lens blank 18 comes into contact with the planar surface 40 of the support ring 36.

Such a beam yoke 72, or alternative sensors of known design in the art for sensing the presence of an object, in combination with the rotary encoder associated with the transport arm 50, can be used to determine the sag of the lens blank 18. The "sag" of the lens blank is the distance between the upwardly disposed planar surface 40 of the blocking ring 36 and the center point of the lens blank 18 when it is positioned in the blocking ring 36. This is helpful information because the planar surface 40 of the blocking ring 36 typically represents the limit of the bonding material B around the lens blank 18, once applied. It is desirous for the operator to know how far below the bonding material the center point of the lens blank 18 extends for processing purposes. This information is difficult to determine after the bonding material is applied.

In operation, as the lens blank 18 is lowered into position on the blocking ring 36, it passes and interrupts the beam 74 of the beam yoke 72. When this occurs, the beam yoke 72 signals the controller 34 to take a reading of the rotary encoder on the transport arm 50 associated with the pivot position of the transport arm 50. In accordance with standard blocking operations, the transport arm 50 proceeds downward until the lens blank 18 is placed on the blocking ring 36. Once the downward movement of the transport arm 50 ceases, i.e., when the lens blank 18 is positioned on the blocking ring 36, the controller 34 takes a second reading of the rotary encoder associated with the end pivot position of the transport arm 50. These two readings are used to determine the sag of the center point of the lens blank 18. If the beam 74 of the beam yoke 72 is positioned above the upwardly directed planar surface 40 of the blocking ring 36, the offset distance is factored into any sag calculation.

While a beam yoke 72 is illustrated in FIGS. 3,4 and 8, alternative sensors may be used for the present invention, including various diode or laser designs. Additionally, more sensors positioned about the periphery of the blocking ring 36 will provide a more complete picture of the lens blank 18 through a greater number of measurements. For example, multiple beam yokes 72 positioned around the blocking ring 36 can be used to determine whether there is any tilt in the lens blank 18 as it is positioned in the blocking ring 36, and if so, how much tilt there is and in which direction. This is helpful information because if the lens blank 18 is bonded to the block 22 with unknown tilt, the surfacing operation can be effect. The surfacing operation of the lens blank 18 can be made more efficient if this tilt is taken into account by the surfacing machine as the lens blank 18 is processed so that the desired prescription is generated.

Alternatively, the present invention measurement apparatus could be implemented as part of the alignment station 16. For example, a beam yoke could be used with the alignment support ring 26 wherein movement of the lens blank 18 onto or off of the alignment support ring 26 could be used to determine the desired measurements; e.g., sag and tilt. In a still further embodiment, the present invention measurement apparatus could be utilized in a measurement station that is independent of the alignment station 16 and the blocking station 20.

After the lens blank 18 is bonded to the block 22, the transport arm 50 pivots to a raised transport position with the bonded lens blank 18 and block 22 held by the gripper 32. The user can grab and remove the bonded lens blank 18 and block 22 as the vacuum to the gripper 32 is discontinued. The transport arm 50 is then free to repeat the process once a new lens blank 18 is positioned on the alignment support ring 26 and a new block 22 is placed within the blocking ring 36.

While preferred embodiments have been shown and described, various modifications and substitutions may be made without departing from the spirit and scope of the present invention. Accordingly, it is to be understood that the present invention has been described by way of example, and not by limitation.

What is claimed is:

1. An apparatus for automatically blocking a lens blank to a block and measuring the lens blank, comprising:

a support base;

an alignment station disposed on the support base for aligning the block with the lens blank; and a blocking station also disposed on the support base; and a lens blank measurement system that, during a bonding operation or blocking process of the lens blank and block, automatically senses data regarding the lens blank that includes the existence and amount of sag and tilt of the lens blank.

2. The apparatus of claim 1, wherein the measurement system is part of the blocking station.

3. The apparatus of claim 1, wherein the measurement system is part of the alignment station.

4. The apparatus of claim 1, wherein the measurement system is independent of the blocking station and alignment station.

5. The apparatus of claim 1, wherein the data sensed is measurement data of the lens blank.

6. The apparatus of claim 5, wherein the measurement data includes sag and tilt data of the lens blank relative to center point of the lens blank.

7. The apparatus of claim 1, wherein the data sensed is alignment information about the lens blank.

8. The apparatus of claim 1, wherein the blocking station further includes a lens blank support.

9. The apparatus of claim 1, wherein the blocking station further includes a block reservoir.

10. The apparatus of claim 1, wherein the blocking station further includes means for injecting heated liquid bonding material between the lens blank and the block which solidifies on cooling to join the lens blank and the block.

11. The apparatus of claim 1, wherein the lens blank measurement system has at least one sensor that generates a beam to sense the presence of the lens blank and signal a controller to initiate desired measurements.

12. An apparatus for automatically blocking a lens blank to a block and measuring the lens blank, comprising:

a support base;

an alignment station disposed on the support base for supporting and aligning a lens blank for blocking with a block;

a blocking station also disposed on the support base for bonding a block to the lens blank in a given orientation relative to the base, the blocking station having a lens blank measurement system, which during a bonding operation or blocking process of the lens blank and block, automatically identifies and determines measurement and alignment information about the lens blank that includes the existence and amount of sag and tilt of the lens blank; and a blocking ring having at least one beam yoke positioned around the periphery of the blocking ring for detecting when the lens blank is being placed at the blocking station, the beam yoke generating a beam that senses the presence of the lens blank and signals a controller to initiate desired measurements, such as sag and tilt, when the beam is interrupted by the presence of the lens blank, the beam being substantially aligned with a projected path of the center point of the lens blank as the lens blank is lowered into position on the blocking ring.

13. The apparatus of claim 12, further including a transport means adjacent to the alignment and blocking stations for moving the lens blank from the alignment station to the blocking station while maintaining a desired lens blank orientation established at the alignment station.

14. The apparatus of claim 13, wherein the transport means includes a transport arm.

15. The apparatus of claim 14, further including a rotary encoder associated with the transport arm and working in conjunction with the beam yoke for measuring the pivot of the transport arm and providing data to a controller.

16. The apparatus of claim 14, further including a movement measuring apparatus to measure linear distance between a first position of the lens blank when the beam is interrupted, and a second position of the lens blank when the lens blank comes into contact with a planar surface of the blocking ring.

17. An apparatus for automatically blocking a lens blank to a block and measuring the lens blank, comprising:

a support base;

an alignment station disposed on the support base for supporting and aligning a lens blank for blocking with a block;

a blocking station also disposed on the support base for bonding a block to the lens blank in a given orientation relative to the base; and an alignment support ring having at least one beam yoke to measure movement of the lens blank onto or off of the alignment support ring to determine desired measurements of the lens blank including sag and tilt.

18. A method of automatically blocking a lens blank to a block and measuring the lens blank, comprising:

lowering a lens blank onto a blocking ring having the lens blank interrupt a beam of at least one beam yoke disposed about the blocking ring;

signaling a controller in communication with the beam yoke to take a first reading of a rotary encoder on a transport arm associated with pivot position of the transport arm;

signaling the controller to take a second reading of the rotary encoder associated with an end pivot position of the transport arm once downward movement of the transport arm ceases and the lens blank is positioned on the blocking ring; and calculating with the first and second reading to determine sag of the lens blank.

19. The method of claim 18 further includes factoring into the sag calculation an offset distance if the beam of the beam yoke is positioned above an upwardly directed planar surface of the blocking ring.

20. The method of claim 18 further includes determining tilt in the lens blank as the lens blank is positioned in the blocking ring.

* * * * *